United States Patent [19]

Herubel

[11] 4,016,627

[45] Apr. 12, 1977

[54] NEEDLE BAR SECURING MEANS ON CHAIN GILL MACHINES

[75] Inventor: Jean Frederic Herubel, Guebwiller, France

[73] Assignee: N. Schlumberger & Cie, Guebwiller, France

[22] Filed: July 8, 1975

[21] Appl. No.: 594,059

[30] Foreign Application Priority Data

July 15, 1974 France ..... 74.24479

[52] U.S. Cl. ..... 19/127

[51] Int. Cl.[2] ..... D01G 19/10

[58] Field of Search ..... 19/128, 129 R, 127

[56] References Cited

UNITED STATES PATENTS

| | | | |
|---|---|---|---|
| 2,111,925 | 3/1938 | Eves | 19/127 |
| 3,854,169 | 12/1974 | Mackie | 19/127 |

FOREIGN PATENTS OR APPLICATIONS

| | | | |
|---|---|---|---|
| 716,794 | 10/1954 | United Kingdom | 19/127 |
| 1,175,471 | 12/1969 | United Kingdom | 19/127 |

*Primary Examiner*—Dorsey Newton

*Attorney, Agent, or Firm*—Toren, McGeady and Stanger

[57] ABSTRACT

A removable fixing system for the needle bars on chain gills, for supporting and driving the bars, in which each bar is pivotally connected, by its two ends on two chains, and has, at one of its ends, a bent extension the free end of which is engaged in a fixed cam groove the configuration of which determines the orientation of the bar at every point on its path. Each bar is mounted for pivoting, by its two ends, respectively adjacent the inner lateral face of one of the two chains and adjacent the external lateral face of the other of the chains, the pivotal connections between each of the two members constituted by each bar and the corresponding chain each being provided by a respective pivot mounted in overhung manner on one of these two members, in a direction transverse to the direction of the chain, and engaged in a corresponding bore of the other member, while locking means ensure axial positioning of the bar on its pivots.

6 Claims, 4 Drawing Figures

NEEDLE BAR SECURING MEANS ON CHAIN GILL MACHINES

This invention relates to the removable fixing systems, for the needle bars of chain gills, for supporting and driving the bars, in which each bar is pivotally connected by its two ends on two chains and has, at one of its ends, a bent extension the free end of which is engaged in a fixed cam groove the configuration of which determines the orientation of the bar at every point on its path.

In known systems of this type, as described for example in French Pat. No. 72/40714, the two chains carry small special bearings each having a longitudinal slot on its side opposed to the chain, while the bars pivot in the said bearings by corresponding cylindrical portions in the vicinity of which there are formed two flat parts by which the bar can be constrained to emerge through the aforesaid slot after the bar has been slighty displaced in the axial direction. Such a solution does not always give entire satisfaction because of its relatively high cost and the difficulties involved in fitting and dismantling the bars, which involve a substantial consumption of time and which require specialist personnel.

The object of the invention is to provide an improved fixing system as aforesaid wherein the above-discussed disadvantages of the previous embodiments are obviated.

With this object in view, the present invention provides a removable fixing system for the needle bars on chain gills, for supporting and driving said bars, in which each bar is pivotally connected, by its two ends on two chains, and has, at one of its ends, a bent extension the free end of which is engaged in a fixed cam groove the configuration of which determines the orientation of the bar at every point on its path, the fixing system being characterised in that each said bar is mounted for pivoting, by its two ends, respectively adjacent the inner lateral face of one of the two chains and adjacent the external lateral face of the other of the chains, the pivotal connections between each of the two member constituted by each bar and the corresponding chain each being provided by a respective pivot mounted in overhung manner on one of these two members, in a direction transverse to the direction of the chain, and engaged in a corresponding bore of the other member, while locking means ensure axial positioning of the bar on its pivots.

This very simple system provides, at an economical cost price, an arrangement wherein mounting and dismantling of the bars is substantially instantaneous and does not necessitate recourse to specialist labour.

In an advantageous embodiment, the pivots which support the bars are constituted by the pins of articulation of the links of the chains and the locking means for axial locking means of each bar is constituted by the bottom itself of the cam groove which opposes the axial displacement of the end face of the bent end of the extension of the said bars. Thus, the function of pivoting and of axial positioning are realised by elements of the machine which already exist for other functions, namely: the pins of articulation of the links of the chain which it is sufficient to extend slightly, and the bottom of the cam groove already absolutely essential for ensuring orientation of the bars over the entire length of their path.

The invention will be described further, by way of example, with reference to the accompanying drawings which illustrate a non-restrictive embodiment of the system for fixing the needle bars on chain gills in accordance with the invention. In the drawings.

Figures 1, 2, 3:
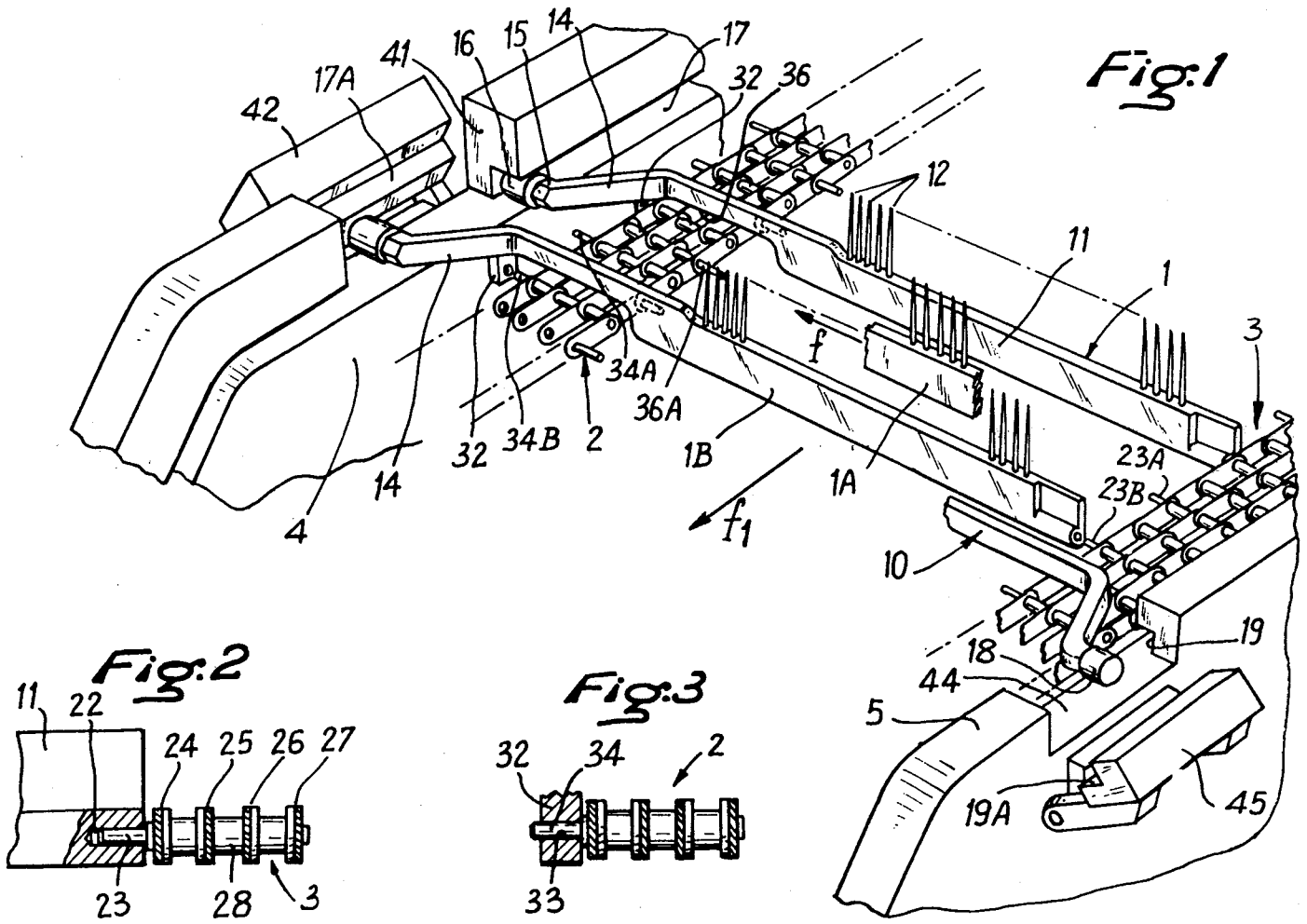
FIG. 1 is a perspective view, with certain parts broken away, illustrating portions of the frame and of the chains of a chain gill machine, with a needle bar in the working position and another in course of being dismantled.
FIG. 2 is an enlarged fragmentary section illustrating one of the support pivots of one of the bars of the machine of FIG. 1.
Figure 4:
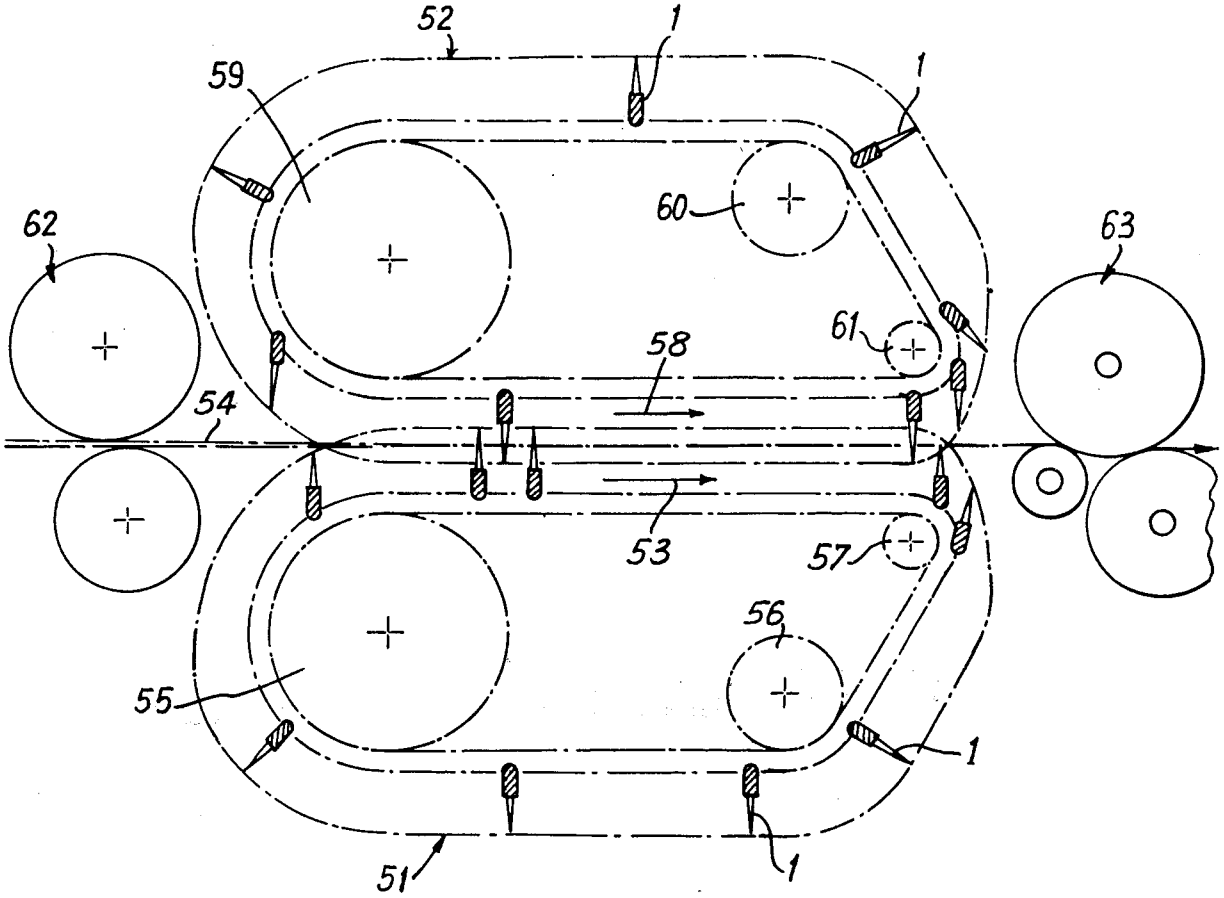

FIG. 3 is a view similar to FIG. 2, but illustrating the other support pivot of said bar; and FIG. 4 is a schematic elevation of a chain gill machine, that is to say a machine for drawing textile fibres which comprises, between feed cylinders and drawing cylinders, one or more needle control fields (there being two in this particular example) the needles of which are fixed on bars mounted on chains by which they are moved.

The chain gill machine shown in FIG. 1 to 3 of the drawing comprises needle bars, such as bar 1, mounted on two parallel support and driving chains 2, 3 which move closely adjacent the internal faces of two cheek plates 4, 5 respectively, forming part of the frame of the machine. Each bar 1 comprises a body 11 in which there is fixed a row of needles 12. At one of its ends, each bar has a bent extension 14 whose end portion 15, which is also bent so that the end of the bar is cranked, bears a roller 16 engaged in a cam groove 17 cut in the inner face of the cheek plate 4.

One bar in two, that is to say the bars such as 1, 1A, 1B, for example, have their extensions 14 situated on the same side, i.e. on the side towards the cheek plate 4 and their corresponding rollers 16 are engaged in the same cam groove 17, while the intermediate bars alternating therewith, such as the bar 10, for example, have their extensions situated on the side towards the cheek plate 5, i.e. their rollers, such as 18, are engaged in a respective cam groove 19 formed in the inner face of the cheek plate 5.

Each bar 1 is mounted for pivoting by the two ends of its body 11, respectively, against the external lateral face of the chain 2 and against the internal lateral face of the chain 3, by means of pivots which, in the example, are carried by the chains.

Thus, the end of the bar body 11 carried by the chain 3 has a bore 22 (see also FIG. 2) in which there is engaged a pivot 23 which is carried by the chain 3 and which extends in a direction transverse to the longitudinal direction of the said chain. In the example, the pivot 23 is constituted by an extension of the articulation pin of links 24, 25, 26 and 27 of the chain. Between the links of the chain there are interposed idle rollers, such as the roller 28. The pivot 23 juts over the lateral internal face of the chain 3. In FIG. 1 there can also be seen the corresponding pivots 23A and 23B of articulation of the corresponding ends of the bars 1A and 1B still on the internal lateral face of the chain 3.

The other end of the body of the bar 11 is provided with an ear or lug 32 (see also FIG. 3) which has a bore 33 fitted on a pivot 34 carried by the external lateral face of the other chain 2 and which, in the example, is constituted by an extension of one pin of articulation of the links of the chain 2.

For the conveniences of production, the portion of the bar body 11 which is at right angles with the chain 2 has a cut-away 36. Between the end of the pivot 34 and the internal face of the cheek plate 4 there remains a space at least equal to the axial width of the ear 32, so that one may disengage this latter, as will be explained later on.

In FIG. 1 there can also be seen, on the external face of the chain 2, two other pivots 34A and 34B destined to receive the corresponding lugs of the bars 1A and 1B.

The intermediate bars, such as 10, are mounted in the same way as the bars such as 1, but in the inverse directions, that is to say that one of their ends is mounted directly on pivots such as 36A on the internal lateral face of the chain 2 and on a pivot carried by the external lateral face of the chain 3 and not visible in FIG. 1, but corresponding, for example, to a pivot such as 34A on the external lateral face of the chain 2 for the other bars 1, 1A, 1B.

When the bars are in place, as is the case for example for the bar 1, they are positioned in the axial direction on their pivots by the end face of the bent end 15 of their extensions 14, which bears in the bottom of the cam groove 17. In a similar way, the axial positioning of the intermediate bars, such as 10, is ensured by the bottom of the cam groove 19 which opposes the displacement of the bars in the axial direction.

To remove a bar such as the bar 1, it is therefor sufficient to displace it in the axial direction on its pivots, in the direction of the arrow *f* transverse to the direction of the chains, so that one of its ends disengages from the pivot carried by the chain 3 and its lug 32 disengages from the corresponding pivot carried by the chain 2. However, for this operation to be possible, it is necessary that the bottom of the cam groove 17 should have an interruption, as represented by the gap 41. To take out the bar 1, it is therefore necessary to start by displacing the chains 2 and 3 in the direction of the arrow *f*1, for example, in order to bring the roller 16 into the notch 41. One can then displace the bar 1 in the direction of the arrow *f* of an amount sufficient to disengage it from its two pivots. It is for this reason that there has to remain, between the internal face of the cheek plate 4 and the pivots, such as 34A, 34B, a distance at least equal to the thickness of the lugs 32. By a reverse movement one can replace a bar.

In operation, the notch 41 is closed by a removable cover 42, for example a hinged cover, which completely bridges the opening and of which a cam portion 17A replaces the interruption of the cam groove 17 in order to ensure continuity of the guiding of the roller 16.

In a similar manner, the other cam groove 19 has an interruption 44 able to be bridged by a similar hinged cover 45 having a corresponding cam-groove portion 19A appropriate to ensure continuity of the said cam groove in normal operation of the machine.

The two hinged covers 42 and 45 are provided with appropriate conventional locking devices which keep them in the closure position in a reliable manner.

The interruptions of the cam grooves and the covers intended to mask them may be replaced by any other equivalent arrangement.

Of course, the intermediate bars, such as the bars 10, may be disengaged from the chains in the same way as the bars such as 1, but in the opposite direction to that of the arrow *f*.

Of course the invention is not restricted to the embodiment above described and shown which has been given by way of example, modifications can be made thereto, depending on the applications envisaged, without however departing from the scope of the invention, as defined by the claims which conclude this specification.

Thus whilst FIG. 1 illustrates an embodiment of the invention applied to the lower needle field of a chain gill machine, one can adopt a similar arrangement for the upper needle field.

In the drawing machine shown in FIG. 4, the bars 1 constitute the lower 51 and upper 52 needled fields. The lower needled field 51 is supported and driven, in accordance with the arrow 53, in the direction of advance of the material 54, by the wheels and pinions 55, 56 and 57, and the upper needled field 52 is supported and driven, in accordance with the arrow 58 in the direction of advance of the material 54, by the wheels and pinions 59, 60 and 61. The material 54 therefore coming from the feed cylinders 62 is supported and controlled by the lower 51 and upper 52 needled fields, in order to be drawn by the drawing cylinders 63.

What I claim is:

1. A chain gill machine comprising a pair of laterally spaced apart endless chains each movable in a path of travel substantially parallel to the path of travel of the other said chain and each said chain having an inner lateral face directed toward the inner lateral face of the other said chain and an outer lateral face directed away from the other said chain, a plurality of substantially parallel elongated needle bars extending transversely of and removably mounted on said chains, each of said needle bars having a first end, a second end and an extension bent relative to the bar extending between said first and said second ends and extending laterally outwardly from said first end, said extension having a free end spaced laterally outwardly from the first end of said needle bar, said first end of each said needle bar being pivotally connected to the laterally outer face of one of said chains and said second end of each said needle bar being pivotally connected to the laterally inner face of the other one of said chains, said first and second ends being pivotally connected about axes extending transversely of the direction of the path of travel of said chains, the pivotal connection of said first and second ends to said chains comprising a first bore associated with said first end and a second bore formed in said second end of each said needle bar and a first pivot located in one of said chains and engageable within said first bore and a second pivot located in the other one of said chains and engageable within said second bore, said first and second pivots connecting said first and second ends of each said needle bar each extending transversely of said chains in the same lateral direction therefrom, and means spaced laterally outwardly from each of said chains and forming a fixed cam groove facing toward the outer lateral face of the adjacent said chain and disposed in parallel relation to the adjacent said chain, and the free end of said extension being engaged in one of said fixed cam grooves and being movable therethrough with the free end of said extension being positioned relative to the base of said fixed cam groove so that said needle bar from which said extension extends is secured against movement in the axial direction of its pivotal connection to said chain adjacent said fixed cam groove whereby said needle bar is retained in pivotal connection with said chains.

2. A chain gill machine, as set forth in claim 1, wherein each said chain comprises a plurality of serially arranged links extending in the direction of the path of travel of said chains and said first and second pivots comprising axially extending pins disposed transversely of the path of travel of said chains and articulating the ends of adjacent said links together, with said first pivot extending transversely outwardly from the outer lateral face of one of said chains and said second pivot extending transversely inwardly from the other one of said chains.

3. A chain gill machine, as set forth in claim 2, wherein the first end of each said needle bar has an integral lug formed thereon, and the first bore for the pivotal connection of said needle bar being formed in said lug.

4. A chain gill machine, as set forth in claim 3, wherein said chains comprise a first said chain and a second said chain, and adjacent ones of said needle bars having the first and second ends thereof reversed relative to one another so that one adjacent said needle bar has the first end thereof connected to said first chain and the other adjacent said needle bar has the first end thereof connected to said second chain.

5. A chain gill machine, as set forth in claim 4, wherein said means spaced laterally outwardly of said chains comprises a pair of cheek plates each located laterally outwardly from the laterally outer face of a different one of said pair of chains, each said cheek plate having one said fixed cam groove formed therein facing toward the outer lateral face of the adjacent said chain so that said extensions on adjacent said needle bars are located in different ones of said fixed cam grooves.

6. A chain gill machine, as set forth in claim 5, wherein each said cheek plate has a removable cover including a portion of the length of said fixed cam groove therein which length extends for a part of the length of the cam groove so that by removing said cover said needle bars having the extensions thereof located in said fixed cam groove within said cheek plate containing said cover can be moved in the direction transverse to the paths of travel of said chains for removing said needle bars from and for reinserting said needle bars into pivotal connection with said chains.

* * * * *